United States Patent [19]

Edel

[11] Patent Number: 4,498,409

[45] Date of Patent: Feb. 12, 1985

[54] MULTI-HULL SAILBOAT

[76] Inventor: Maurice Edel, Chemin du Moulin d'Amont, 69150 Decines, France

[21] Appl. No.: 434,556

[22] Filed: Oct. 15, 1982

[30] Foreign Application Priority Data

Oct. 15, 1981 [FR] France ..... 81 19634

[51] Int. Cl.[3] ..... B63B 1/12

[52] U.S. Cl. ..... 114/61; 114/283

[58] Field of Search ..... 114/61, 123, 283, 292, 114/39; D12/304

[56]. References Cited

U.S. PATENT DOCUMENTS

| | | | |
|---|---|---|---|
| 996,444 | 6/1911 | Yarrington | 114/61 |
| 2,585,599 | 2/1952 | Tchetchet | 114/61 |
| 3,208,421 | 9/1965 | Landes et al. | 114/292 |
| 3,796,175 | 3/1974 | Ford et al. | 114/61 |
| 3,866,557 | 12/1975 | Lang | 114/61 |
| 3,996,871 | 12/1976 | Boismard | 114/61 |
| 4,287,845 | 9/1981 | Sanner | 114/61 |

FOREIGN PATENT DOCUMENTS

| | | | |
|---|---|---|---|
| 2034253 | 6/1980 | United Kingdom | 114/61 |

*Primary Examiner*—Trygve M. Blix
*Assistant Examiner*—Stephen P. Avila
*Attorney, Agent, or Firm*—Schwartz, Jeffery, Schwaab, Mack, Blumenthal & Koch

[57] ABSTRACT

A multi-hull sailboat in which the hulls each have the bow portion and the fore of the mid-hull relatively shallow and of relatively wide cross-section while the stern and the aft of the mid-hull portion have relatively deep draft and narrow cross-section such that the latter functions as a keel and the hull is streamlined with the rudder being a projection of the stern portion of the hull.

6 Claims, 9 Drawing Figures

10
12
14
16
18
20
22
24
26
28
30
32
34
36
1
2
3
4
5
H

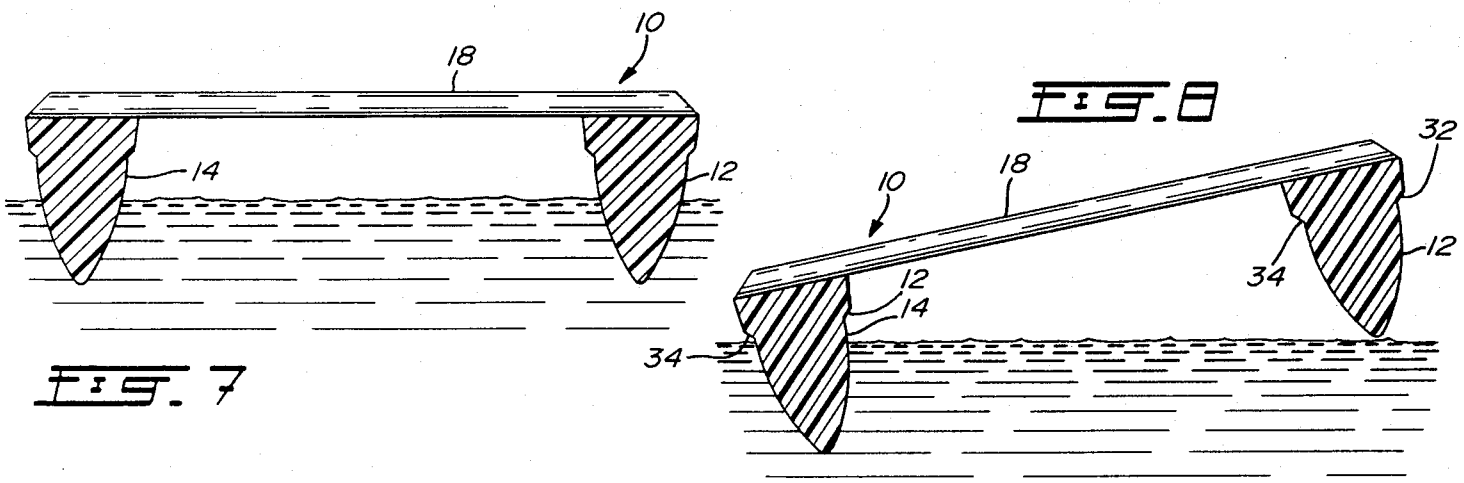
FIG. 7
FIG. 8
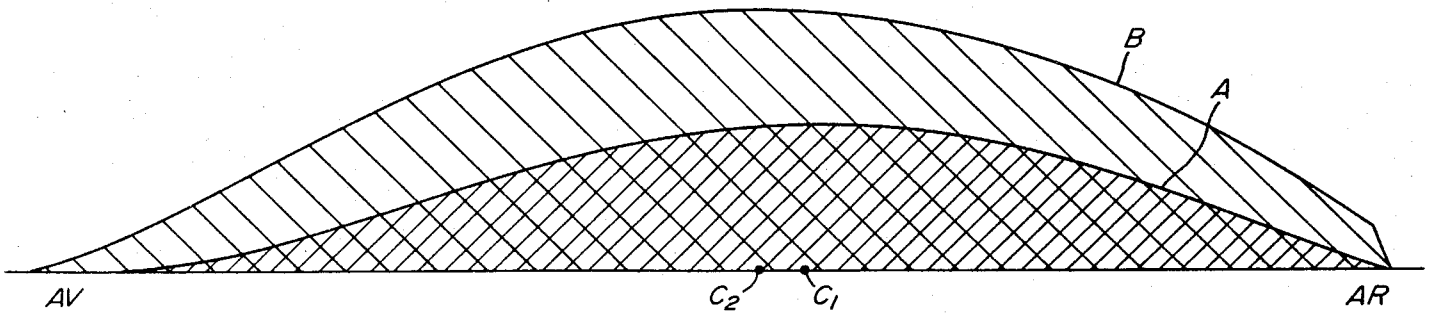
FIG. 9

MULTI-HULL SAILBOAT

BACKGROUND OF THE INVENTION

1. Field of the Invention

The present invention relates to improvements with respect to multi-hull sailboats, and particularly to the design of the hulls of a catamaran-type sailboat.

2. Description of the Prior Art

Catamaran sailboats have very attractive qualities, the most important being the speeds they can attain compared to mono-hull boats. However, because of the design of conventional hulls for catamarans, a deep rudder and center board, extending far below the normal draft of the hull, are required. All of these elements, of course, must be raised, in certain cases to avoid grounding.

Furthermore, it is well known that it is extremely difficult to tack a catamaran into the wind, making it necessary during moderate winds, to gybe. This, of course, is a very inefficient manner of changing direction since it requires the sailboat to turn 270° when, in fact, a tack of 90° would be sufficient.

Furthermore, it is well known that catamarans present poor longitudinal stability when the catamaran is heeling with one of the hulls out of the water. Only an experienced crew positioned well aft of the mast can prevent the bow from "diving". Of course, once the bow of the floating catamaran hull is submerged, the crew must luff the catamaran in order to avoid capsizing, thereby considerably reducing the speed efficiency of such sailboats.

SUMMARY OF THE INVENTION

It is an aim of the present invention to provide an improved hull design for catamarans, wherein the advantages of conventional catamaran hulls are maintained, such as speed, but with improved longitudinal and transversal stability even though a deep rudder and center board are eliminated.

It is a further aim of the present invention to overcome the problems of longitudinal instability, thus reducing the risk of diving phenomena when the catamaran is heeling with one hull out of the water.

A construction in accordance with the present invention comprises a hull for a multi-hull sailcraft including a bow portion, a mid-hull portion and a stern portion, the bow portion and the fore of the mid-hull portion having relatively shallow draft and having a relatively wide cross-section, while the stern portion and the aft of the mid-hull portion have a relatively deep draft and a relatively narrow cross-section such that the aft of the mid-hull and the stern function as a fin keel; and the hull being streamlined and a rudder being provided as a streamlined projection of the stern portion of the hull.

In a more specific embodiment of the present invention, the hull includes, particularly in the mid-hull and stern portions, surfaces forming a stepped shoulder on either side extending laterally of the hull forming planing surfaces above the water line of the hull. In fact, these lateral surfaces define an enlarged head of the hull, thereby greatly increasing the buoyancy volume of the hull as the hull recedes below the water line during heeling.

From this, it can be seen that the cross-sectional area of the hull which can be submerged will be doubled compared to the cross-sectional area of the submerged portion of the hull when the catamaran is upright. The buoyancy, therefore, is proportionally increased as the hull recedes below the water line. It has also been noted that the center of buoyancy is displaced to the fore as the catamaran heels. Finally, it is noted that in the design of the hull, the forefoot of the hull of the bow is above the normal water line of the hull.

It is also noted that the hull, in accordance with the present invention, can be manufactured using conventional techniques, and any type of said rigging can be used ranging from a sailboard technique to conventional sloop rigging.

BRIEF DESCRIPTION OF THE DRAWINGS

Having thus generally described the nature of the invention, reference will now be made to the accompanying drawings, showing by way of illustration, a preferred embodiment thereof, and in which:

FIG. 7 is a schematic view of a catamaran taken from the front thereof;

FIG. 8 is a schematic view, similar to FIG. 7, but showing the catamaran in a different operating position; and FIG. 9 is a graph plotting the longitudinal cross-sectional area of the hull in a horizontal position and in a heeling position.

DESCRIPTION OF THE PREFERRED EMBODIMENTS

Figures 1, 2, 3, 4, 5, 6:
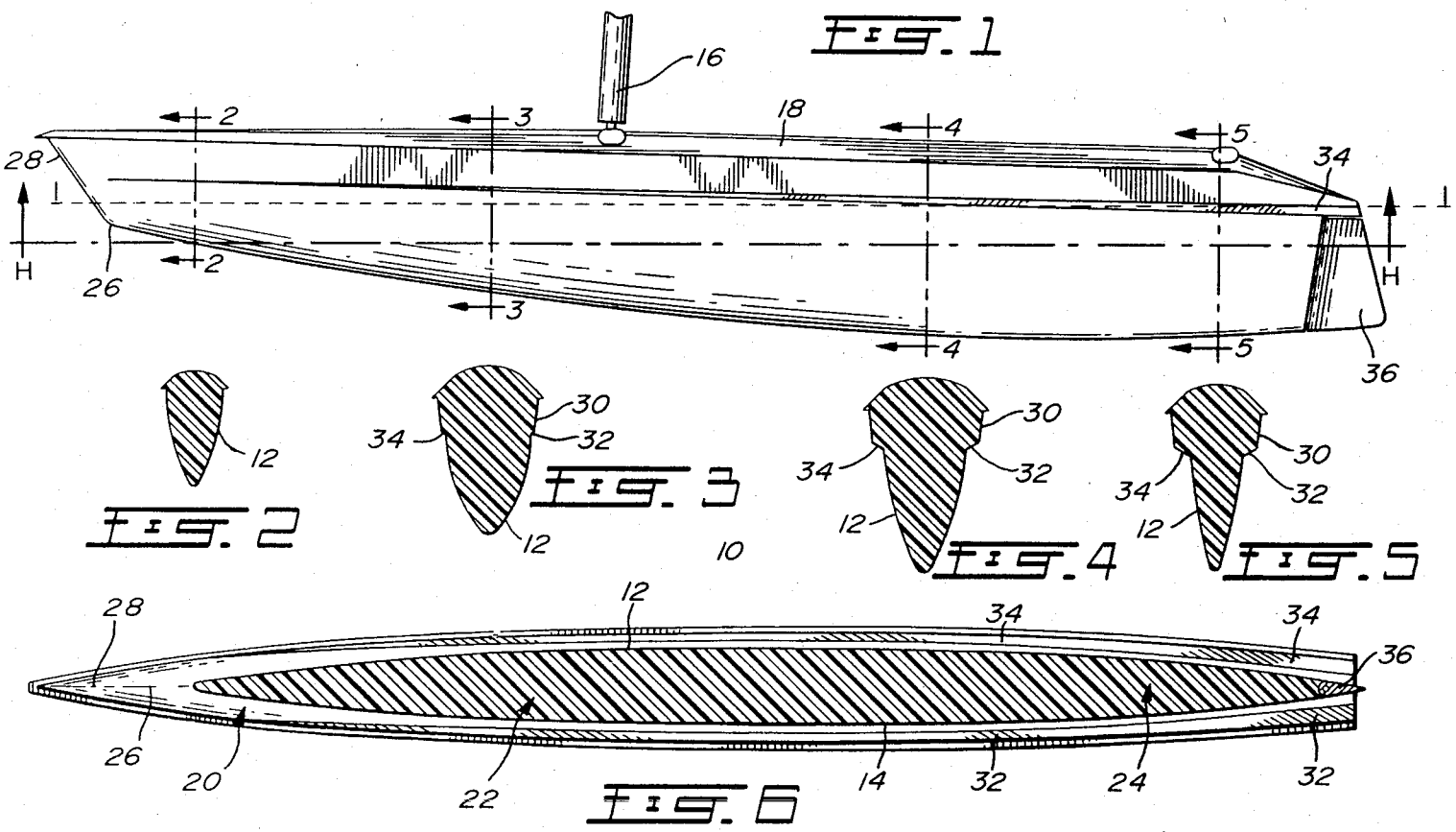
FIG. 1 is a side elevation of the port hull of a catamaran.
FIG. 2 is a vertical cross-section taken along line 2—2 of FIG. 1.
FIG. 3 is a vertical cross-section taken along line 3—3 of FIG. 1.
FIG. 4 is a vertical cross-section taken along line 4—4 of FIG. 1.
FIG. 5 is a vertical cross-section taken along line 5—5 of FIG. 1.
FIG. 6 is a bottom plan view, partly in cross-section, of the hull shown in FIG. 1.

Referring now to the drawings and particularly to FIGS. 1 through 8, a catamaran 10 having a port hull 12 and a starboard hull 14 is shown. A mast 16 is provided on a deck 18 bridging the hulls 12 and 14. Conventional rigging would, of course, be provided on the catamaran 10 in association with the mast 16.

Only hull 12 will be described since both hulls 12 and 14 are identical. If one refers to FIGS. 1 through 6, the hull 12 comprises a streamlined hull design having a bow section 20, a mid-hull section 22, and a stern section 24. The normal water line of the hull is identified by the letter H, while the water line when the catamaran is heeling at approximately 12° is represented by the letter I.

The bow section 20 and the fore portion of the mid-hull section 22 has a definitive fully rounded shape and is wider in comparison to the aft portion of the mid-hull section 22 and the stern portion 24 as represented by FIGS. 4 and 5. The aft portion of the mid-hull 22 and the stern portion 24 have a definitive V-shape through the bottom of the hull which is, of course, narrower than the fore section and which also acts or functions as a fin keel, thereby eliminating the need for a retractable deep center board in each hull. The shape of the hull, as described above, provides a more buoyant bow with a shallower draft and a progressively less buoyant aft or stern with a deeper draft forming the fin keel.

As can be seen from the drawings, the particular design results in the forefoot 26 of the hull 12 being completely above the water line HH. As illustrated in FIG. 6, the hull has a head portion 30 which is of increased volume and of a greater lateral extent than the lower part of the hull. Shoulders 32 and 34 are also present, particularly in the stern 24 and aft portion of the mid-hull section 22. These surfaces 32 and 34 act as planing surfaces. It is evident from this construction that as the catamaran 10 heels, one of the hulls, for example, hull 12, lifts out of the water as shown in FIG. 8. The hull 14 will gradually recede into the water, but as its draft increases, it becomes progressively more buoyant, particularly as the head portion 30 begins to be immersed. It has also been noted that the shoulders 32 and 34 are of great help in giving the catamaran 10 a planing attitude for skipping over the waves.

Finally, the rudder 36, as shown in FIGS. 1 and 6, can be a projection of the streamlined surfaces of the hull, particularly in the stern area and, of course, would be conventionally hinged to the aft end of the stern. It has been found that the construction of the rudder as a projection of the hull eliminates the need for a deep rudder, particularly since the stern of the hull has a considerable draft.

It has been found that the design of the present invention provides for more longitudinal stability and a resistance to diving when one of the hulls is immersed and the other hull is out of the water. If one refers to the graph in FIG. 9, for instance, the cross-sectional area of the hull, which is immersed with the catamaran in the horizontal position is plotted along curve A while curve B represents the cross-sectional area of the hull which has been immersed when there is 12° of heel. $C_1$ represents the center of buoyancy of the catamaran when it is in a horizontal position, while $C_2$ represents the center of buoyancy of the catamaran when the catamaran is at a 12° angle of heeling. AV represents the front of the bow while AR represents the rear of the stern. The center of buoyancy moves forward when the boat is heeling, thereby helping to lift the bow out of the water rather than forcing it to dive as with conventional hulls. Further, because the bow has a portion thereof which is out of the water in normal sailing, it will have a greater ease of tacking into the wind since the pivot point of rotation will be behind the mast as the stern portions of the hulls are submerged and acting as center boards.

I claim:

1. A hull for a multi-hull sailcraft, the hull being streamlined and including a bow section, a mid-hull section, and a stern section, the bow section and the fore of the mid-hull section having shallow draft and having a wide cross-section in order to provide maximum buoyancy, the stern section and the aft of the mid-hull section having a gradually deepening draft and a gradually narrowing V-shaped cross-section relative to the fore section of the mid-hull such that the aft of the mid-hull and the stern function as a leeboard, and the center of buoyancy tends to move forward as the hull is immersed deeper in water.

2. A hull as defined in claim 1, wherein the mid-hull section and the stern section are provided with an enlarged head wider than the width of the hull to progressively increase the buoyancy volume of the hull as the hull recedes below the water line.

3. A hull as defined in claim 2, wherein the enlarged head of the hull is provided with underside planing surfaces on either side thereof in order to improve the planing capability of the catamaran.

4. A hull as defined in claim 1, wherein the bow is provided with a stem, the stem terminating in a forefoot which is above the normal water line of the catamaran.

5. A hull for a multi-hull sailcraft as defined in claim 1, wherein the draft of the hull gradually increases from the forefoot to the stern section of the hull while the width of the hull gradually decreases from a portion of the hull between the bow and the fore portion of the mid-hull section to the aft edge of the stern.

6. A hull as defined in claim 5, wherein the rudder is a streamlined projection of the stern.

* * * * *